United States Patent [19]

Cooper, Jr. et al.

[11] 4,128,359

[45] Dec. 5, 1978

[54] SELF-PROPELLED CONCRETE VIBRATOR APPARATUS

[76] Inventors: Charles R. Cooper, Jr., 1315 S. 3rd; Charles K. Ellis, 1608 N. 17th St., both of Beatrice, Nebr. 68301; David Starcher, 517 Shepherd Dr., Mansfield, Ohio 44907

[21] Appl. No.: 851,361

[22] Filed: Nov. 14, 1977

[51] Int. Cl.[2] ..... E61C 19/38

[52] U.S. Cl. ..... 404/72; 404/116; 14/1

[58] Field of Search ..... 404/115, 114, 116, 106, 404/118, 119, 84, 101, 83, 87, 72; 14/73.1

[56] References Cited

U.S. PATENT DOCUMENTS

| | | | |
|---|---|---|---|
| 1,720,377 | 7/1929 | Pope | 404/116 |
| 2,148,214 | 2/1939 | Mall | 404/116 |
| 2,223,734 | 12/1940 | Mall | 404/116 |
| 2,248,103 | 7/1941 | Mall | 404/116 |
| 2,255,344 | 9/1941 | Baily | 404/116 |
| 2,382,096 | 8/1945 | Pierce | 404/115 |
| 3,113,494 | 12/1963 | Barnes | 404/114 |

*Primary Examiner*—Nile C. Byers, Jr.
*Attorney, Agent, or Firm*—Zarley, McKee, Thomte, Voorhees & Sease

[57] ABSTRACT

A self-propelled concrete vibrator machine adapted for movement along a pair of spaced-apart guide rails which are positioned on the bridge centering upon which the concrete is to be poured. The concrete vibrator machine is adapted to be moved along the guide rails closely adjacent the forward end of a concrete finishing machine. The vibrator machine comprises first and second drive units mounted on the guide rails for selective movement on the guide rails in either forward or reverse directions. A truss assembly is secured to the rearward ends of the drive units and extends therebetween over the area upon which the concrete is being poured. A plurality of vertically disposed and horizontally spaced hydraulic vibrators are mounted on the rearward end of the truss assembly. The hydraulic vibrators are vertically movably mounted relative to the truss assembly so that the hydraulic vibrators may be moved from an upper position above the concrete to a lowered position wherein the hydraulic vibrators are positioned in the concrete. Apparatus is provided for controlling the vibrational speed of the hydraulic vibrators as well as the length of time the vibrators are in the concrete. The hydraulic vibrators may be also moved horizontally when in their upper position so that a reduced number of hydraulic vibrators may be employed. The vibrator machine is moved along the guide rails closely adjacent the forward end of the finishing machine so that the concrete may be vibrated at predetermined spacings for predetermined lengths of time immediately prior to the concrete being finished by the finishing machine.

34 Claims, 5 Drawing Figures

SELF-PROPELLED CONCRETE VIBRATOR APPARATUS

BACKGROUND OF THE INVENTION

This invention relates to a concrete vibrator machine and more particularly to a concrete vibrator machine adapted for use in combination with a concrete finishing machine.

To form a bridge deck, concrete is normally poured between a pair of spaced-apart guide rails which run the length of the bridge deck. The concrete is normally poured on the bridge centering after reinforcing rods or re-bars have been positioned thereon. The concrete is poured immediately in front of a concrete finishing machine which runs on the guide rails and travels along the length thereof. It is necessary to vibrate the concrete with vibrator devices to achieve the desirable concrete consolidation.

A problem associated with the vibrating of the concrete is that the concrete tends to harden very quickly after being vibrated so it is imperative that the concrete be vibrated in close proximity to the forward end of the concrete finishing machine so that the concrete may be suitably finished. If the concrete is vibrated some distance ahead of the finishing machine, the concrete will harden to such a degree that the finishing machine cannot suitably finish it since it takes some time for the finishing machine to travel the distance between the point of vibration and the point of finishing.

Quite often, the specifications of the bridge deck will require that the concrete be vibrated at predetermined spacings for predetermined lengths of time and that the vibrators not be permitted to come into engagement with the re-bars. Another requirement or specification for some bridge decks is that the vibrator devices be lowered into the concrete in a substantially vertically disposed position. Heretofore, a plurality of vibrators were operated by workmen who attempted to insert the vibrators into the concrete at the predetermined spacings for predetermined lengths of time. The spacings and lengths of time are not accurate since the same depends upon the guesswork of the worker. Additionally, the workers experience fatigue during long pours and the desirable vibrating specifications are not met.

Therefore, it is a principal object of the invention to provide an improved concrete vibrator machine.

A still further object of the invention is to provide a self-propelled concrete vibrator machine.

A still further object of the invention is to provide a self-propelled concrete vibrator machine which is adapted to be used in combination with a concrete finisher machine.

A still further object of the invention is to provide a self-propelled concrete vibrator machine which includes means for inserting hydraulic vibrators at predetermined spacings for a predetermined length of time.

A still further object of the invention is to provide a self-propelled concrete vibrator including a truss assembly extending between spaced-apart drive units.

A still further object of the invention is to provide a self-propelled concrete vibrator machine having a plurality of vertically and horizontally movable vibrator devices mounted on a truss assembly in such a manner so that the vibrator devices may be closely positioned to a concrete finisher machine.

A still further object of the invention is to provide a self-propelled concrete vibrator machine which is adapted to span various bridge deck widths.

A still further object of the invention is to provide a self-propelled concrete vibrator machine which is adjustable to comply with various specifications.

A still further object of the invention is to provide a self-propelled concrete vibrator machine including a truss assembly which is comprised of a plurality of truss sections detachably secured together in an end-to-end relationship.

A still further object of the invention is to provide a self-propelled concrete vibrator machine which is durable in use and refined in appearance.

A still further object of the invention is to provide a support means for a vibrator apparatus which distributes the weight of the support means sufficiently to prevent collapse of the spaced-apart guide rails upon which the machine is travelling.

These and other objects will be apparent to those skilled in the art.

SUMMARY OF THE INVENTION

First and second drive units are positioned on spaced-apart guide rails which form a part of the bridge centering. The engines of the drive units are mounted on the forward ends of the drive units and a truss assembly extends between the rearward ends of the drive units to distribute the weight of the machine on the guide rails to prevent the collapse thereof. A plurality of vertically disposed and horizontally spaced hydraulic vibrators are mounted on the rearward end of the truss assembly and are vertically movable into and out of the concrete. The vibrators may also be moved horizontally when in their upper position to achieve the proper vibration spacing with a reduced number of vibrators. The design of the drive units and truss assembly is such that the concrete will be vibrated closely adjacent the forward end of the bridge deck concrete finishing machine. Control means is provided for: (1) raising and lowering the vibrators at a predetermined rate; (2) moving the vibrators horizontally; (3) controlling the vibrational rate of the vibrators individually and collectively; and, (4) the individual speed of the drive units in either forward or reverse directions.

DESCRIPTION OF THE PREFERRED EMBODIMENT

Figure 1:
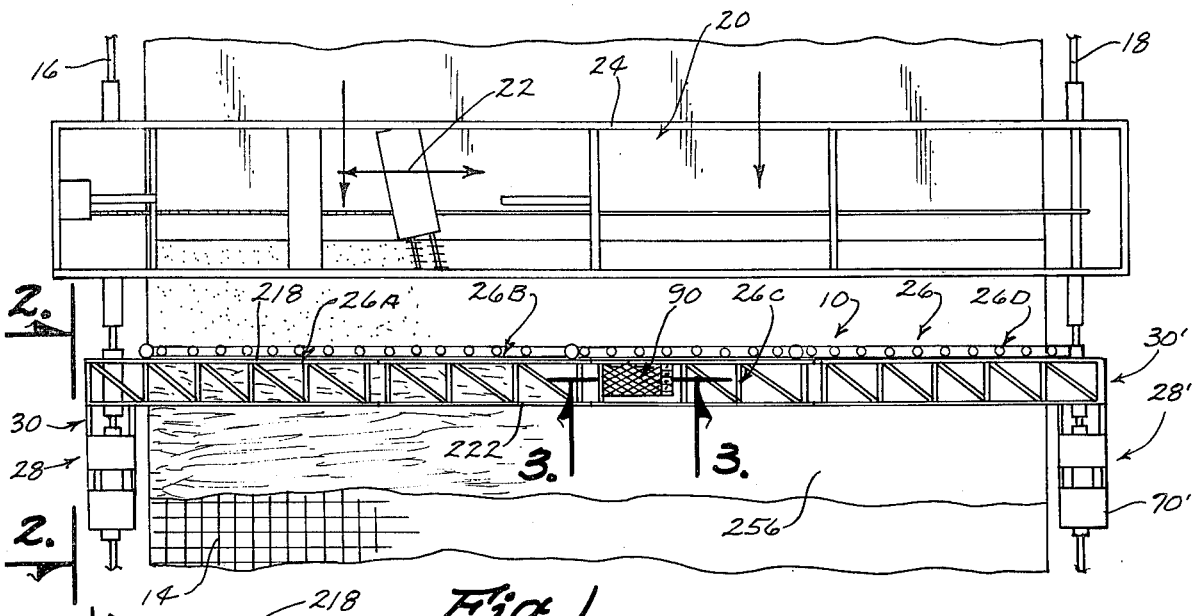
FIG. 1 is a partial plan view of the vibrator machine of this invention being employed in combination with a concrete finisher machine.
Figure 2:
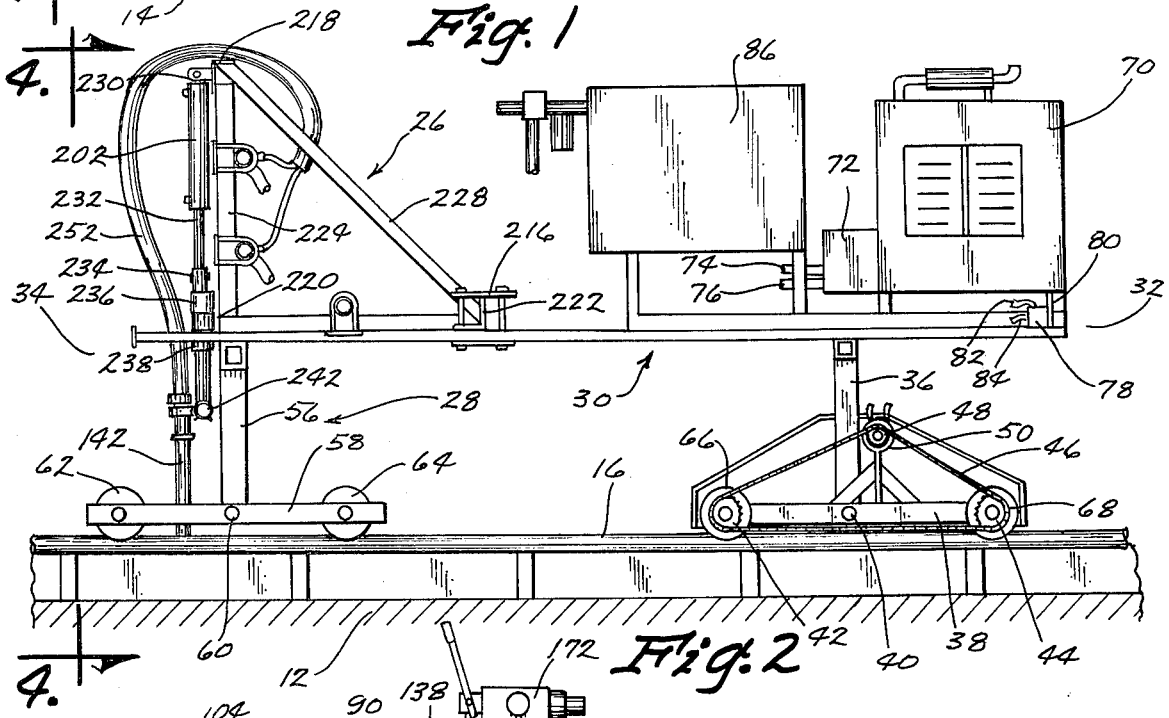
FIG. 2 is an enlarged end view of the vibrator machine of this invention as seen on lines 2—2 of FIG. 1.
Figure 3:
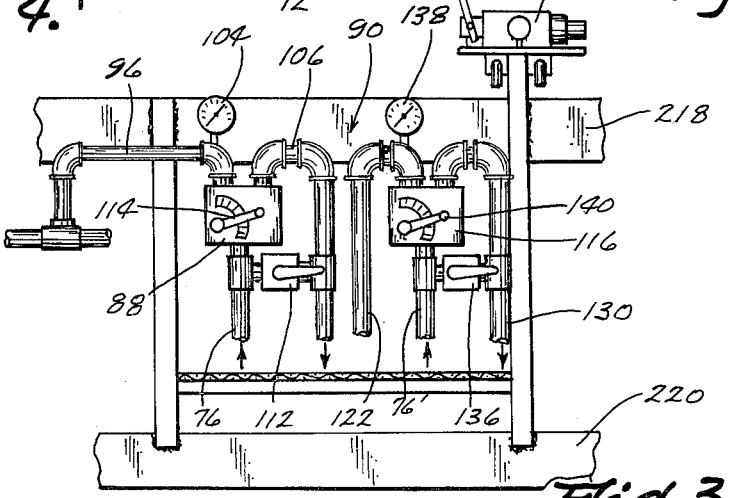
FIG. 3 is an enlarged sectional view as seen on lines 3—3 of FIG. 1.

The numeral 10 refers generally to a concrete vibrator machine of this invention which is adapted to vibrate concrete positioned on a bridge centering 12 or the like having reinforcing bars or re-bars 14 positioned thereon between a pair of spaced-apart guide rails 16 and 18. The numeral 20 refers generally to a conventional bridge deck concrete finisher machine such as a Bid-well boom truss roller finisher. The finisher 20 is adapted to be propelled along the guide rails 16 and 18 and to finish the concrete by means of a finishing roller and auger assembly 22 which moves transversely with respect to a truss 24. The finisher machine 20 includes a power means for moving the finisher machine 20 along the guide rails 16 and 18 and for moving the assembly 22 in the direction illustrated by the arrows in FIG. 1.

Vibrator machine 10 generally comprises a truss assembly 26 which is secured to and which extends between drive frame 28 and 30 movably mounted on the guide rails 16 and 18 respectively.

Drive frame 28 includes a frame means 30 having a forward end 32 and a rearward end 34. Frame member 36 extends downwardly from frame means 30 adjacent the forward end thereof and has frame member 38 pivotally connected thereto by means of pin or bolt 40. Sprockets 42 and 44 are rotatably mounted on opposite ends of the frame member 38 and have a drive chain 46 extending therearound which also engages drive sprocket 48 of hydraulic motor 50 having hydraulic lines 52 and 54 connected thereto. A frame member 56 extends downwardly from the rearward end of frame means 30 and has frame member 58 pivotally connected to the lower end thereof by pin or bolt 60. Wheels 62 and 64 are rotatably mounted on the opposite ends of frame member 58 and roll upon guide rails 16. It should be noted that drive wheels 66 and 68 are operatively connected to the sprockets 42 and 44 for rotation therewith and that the wheels 66 and 68 engage the upper surface of guide rail 16. Thus, actuation of hydraulic motor 50 causes drive wheels 66 and 68 to be rotated in either a forward or rearward direction relative to the guide rail 16 to propel the drive unit 28 along the length of the guide rail 16.

Figure 5:
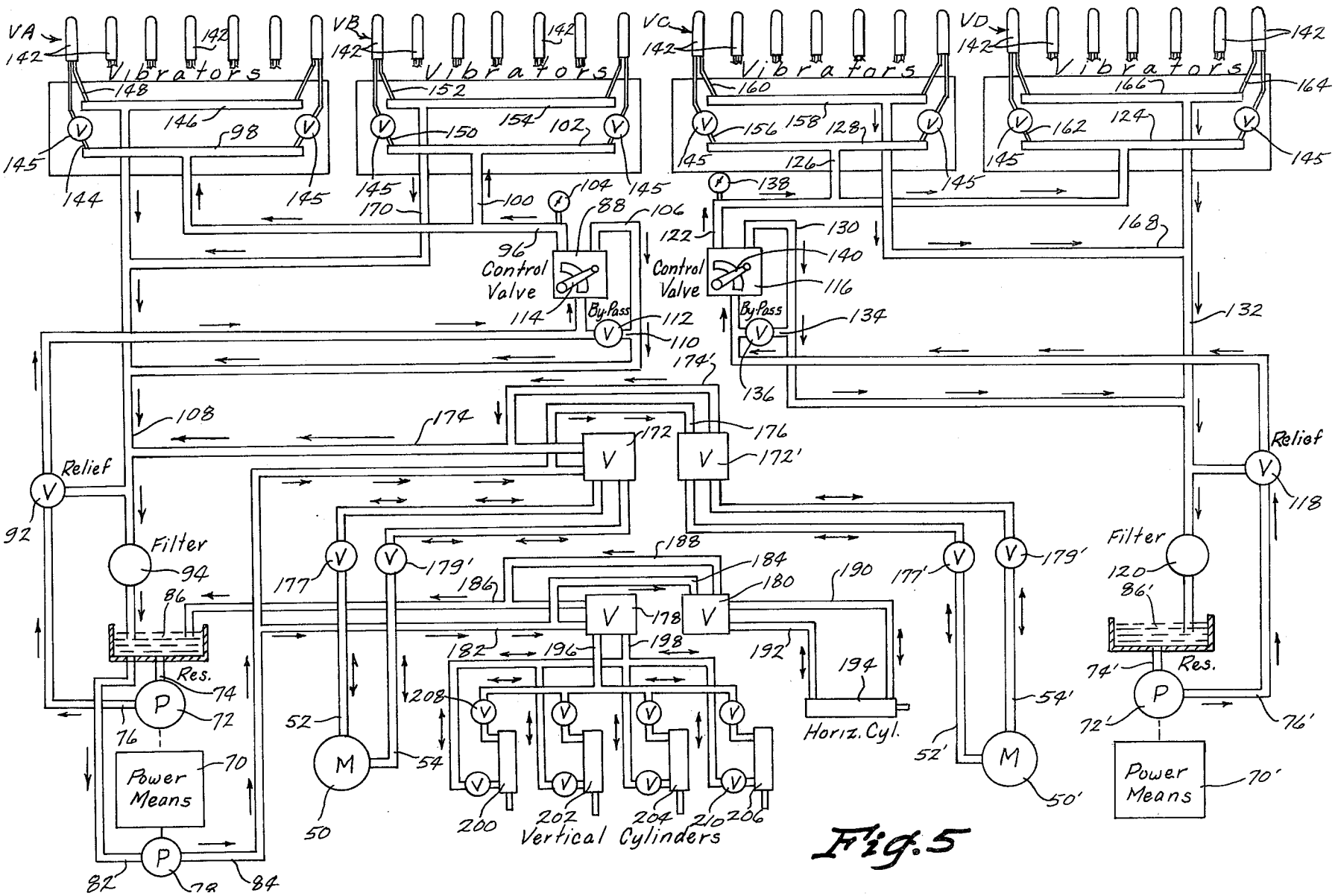
FIG. 5 is a schematic view of a hydraulic circuitry of the invention.

Gasoline engine 70 is mounted on frame means 30 adjacent the forward end thereof. Hydraulic pump 72 is operatively connected to the crank shaft of the engine 70 and has hydraulic lines or hoses 74 and 76 extending therefrom. The numeral 78 refers to a hydraulic pump which is driven by means of a belt 80 connected to the water pump of the engine 70 in which has lines or hoses 82 and 84 connected thereto. As seen in FIG. 5, line 74 connects pump 72 with a hydraulic reservoir 86. Hydraulic line 82 connects pump 78 with the reservoir 86.

Drive unit 28' is substantially identical to drive unit 28 except that it does not have a small pump mounted thereon corresponding to pump 78. Inasmuch as drive unit 28' is substantially identical to drive unit 28, "'" will be used to designate identical structure on drive unit 28'. Drive unit 28' includes a gasoline engine 70' having a pump 72' driven thereby with hydraulic lines 74' and 76' extending therefrom. Line 74' connects 72' with reservoir 86'. A hydraulic motor 50' is provided on the drive unit 28' for propelling the drive unit 28' along the length of the guide rail 18. As seen in FIG. 5, the hydraulic motor 50' has hydraulic lines 52' and 54' extending therefrom.

Line 76 extends from pump 72 to the manually adjustable control valve 88 located at the operator's station referred to generally by the reference numeral 90. Relief valve 92 is imposed in the line 76. The numeral 94 refers to a filter located as the reservoir. Discharge line 96 extends from the valve 88 to inlet manifold 98 which will be described in more detail hereinafter. Line 100 connects discharge line 96 with manifold 102. Pressure gauge 104 is in communication with the discharge line 96 to enable the operator to determine the pressure at the discharge side of valve 88. Line 106 extends from valve 88 to line 108 which is in communication with the reservoir 86 as illustrated in FIG. 5. Bypass line 110 connects line 76 with line 106 and has a bypass valve 112 imposed therein. Control valve 88 is adjusted by means of the control handle 114.

Line 76' is connected to the manually adjustable control valve 116 and has relief valve 118' and filter 120 provided therein. In the drawings, valve 118 and filter 120 are shown as separate components but they may be a single component if desired. Discharge line 122 extends from control valve 116 to manifold 124. Line 126 connects line 122 with the manifold 128. Line 130 extends from control valve 116 to the line 132 which is connected to the reservoir 86' as seen in FIG. 5. Bypass line 134 extends between lines 76' and 130 and has bypass valve 136 provided therein. Pressure gauge 138 is also provided in communication with line 122 to enable the operator to determine the pressure at the discharge side of the valve 116. Control valve 116 is controlled by means of the manually adjustable valve handle 140.

A plurality of conventional hydraulic vibrators 142 are mounted on the truss assembly 26 as will be described in more detail hereinafter. For purposes of description, the vibrators 142 will be described as being mounted in banks or gangs VA, VB, VC and VD respectively. Each of the vibrators 142 in gang VA is individually connected to the manifold 98 by means of a line 144. Likewise, the discharge or outlet side of each of the vibrators 142 in gang VA is individually connected to manifold 146 by means of a line 148. Similarly, each of the vibrators 142 in gang VB is connected to the manifold 102 by a line 150. Each of the vibrators 142 in gang VB has a discharge line 152 extending therefrom to manifold 154. Likewise, each of the vibrators 142 in gang VC is connected to the manifold 128 by a line 156. The discharge side of each of the vibrators 142 in gang VC is connected to manifold 158 by means of a line 160. Lines 162 connect the manifold 124 with each of the vibrators 142 which have discharge lines 164 extending therefrom to a manifold 166. Manifold 166 is fluidly connected to line 132. As seen in FIG. 5, manifold 158 is connected to line 132 by means of line 168. Line 170 connects manifold 154 with line 108 which is also connected to manifold 146. Manually adjustable flow control valves 145 are provided in each of the supply lines 144 for each of the vibrators 142 to permit the speeds of all vibrators 142 to be matched or to vary the speed of each vibrator as may be required.

Variable flow control valves 172 and 172' are provided at the operator's station 90 for controlling the speed and direction of the drive units 28 and 28' respectively. As seen in FIG. 5, valve 172 is connected to motor 50 by means of the lines 52 and 54 and valve 172' is connected to motor 50' by means of the lines 52' and 54'. Return line 174 extends from valve 172 to the line 108. Return line 174' extends from valve 172' to the line 174. Line 84 which extends from pump 78 is connected to the valve 172 and to the valve 172' by means of the line 176. Manually adjustable flow control valves 177, 179, 177' and 179' are provided in lines 52, 54, 52' and 54' respectively to permit the speed of both drive frames to be matched or synchronized. In other words, when the valve actuator levers of valves 172 and 172' are fully positioned in their forward or reverse positions, the valves 177, 179, 177' and 179' are adjusted to achieve equal speed of the motors 50 and 50'.

Valves 178 and 180 are also provided at the operator's station 90 for controlling the vertical and horizontal movement of the vibrators 142 respectively. The intake side of valve 178 is connected to line 84 by means of line 182. Line 184 connects line 182 with the intake side of valve 180. Return line 186 extends from valve 188 to the reservoir 86. Return line 188 extends from valve 180 to the return line 186. Valve 180 has lines 190 and 192 extending therefrom which are connected to the opposite ends of cylinder 194 which is adapted to move the vibrators 142 in a horizontal manner as will be described in more detail hereinafter.

Valve 178 has a pair of lines 196 and 198 extending therefrom which are connected to opposite ends of hydraulic cylinders 200, 202, 204 and 206. As seen in FIG. 5, each of the cylinders 200, 202, 204 and 206 has flow control valves 208 and 210 associated therewith for controlling the rate of cylinder rod extension and retraction to match the rate of lowering or raising the vibrators 142 to achieve uniform displacement up and down along the total length of the machine. Line 212 connects relief valve 92 with line 108.

Figure 4:
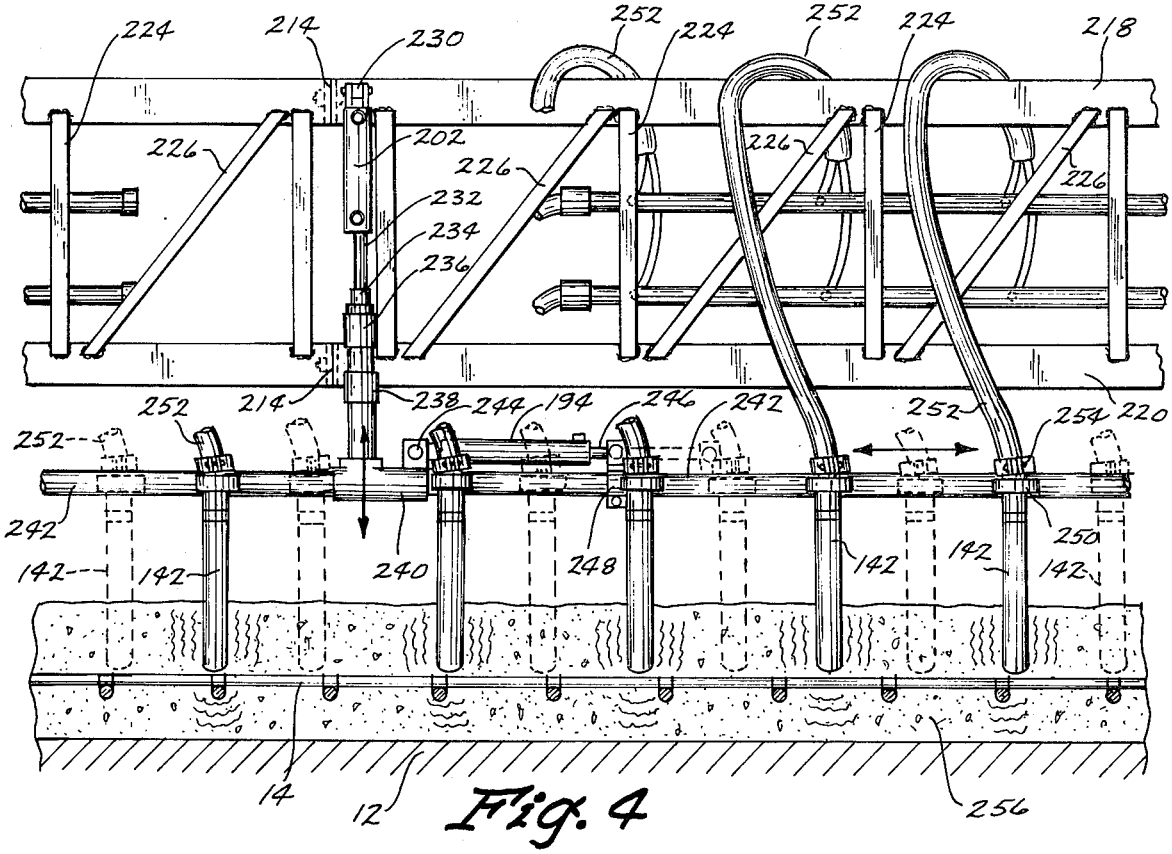
FIG. 4 is a sectional view as seen on lines 4—4 of FIG. 2 with the broken lines illustrating the alternate positions of the vibrators.

Truss assembly 26 is comprised of truss sections 26A, 26B, 26C and 26D bolted together at their ends such as at 214 in FIG. 4. Truss assembly 26 may be used with any number of the truss sections depending on the width of the concrete being vibrated. The outer ends of truss sections 26A and 26D are adjustably bolted to the frame means 30 and 30' by clamps 216 or the like. Thus, if the guide rails 16 and 18 are 40 feet apart and the wheels of the drive frames 28 and 28' have been previously positioned apart slightly greater than 40 feet, the clamps 216 are loosened and the truss assembly 26 is moved longitudinally with respect to the drive frames 26 and 26' or vice versa to achieve the proper spacing.

Each of the truss sections has an elongated upper frame member 218, a rearward lower frame member 220 and a forward lower frame member 222. Lower rearward frame member 220 is disposed in the same vertical plane as upper frame member 218 and has a plurality of vertically disposed brace members or web members 224 and a plurality of diagonally extending web members 226 secured thereto and extending therebetween. A plurality of web members 228 are secured to upper frame members 218 and lower forward frame member 222 and includes some web members extending transversely to the frame members 222 and 218 as well as some web members extending diagonally between frame members 222 and 218. A plurality of transversely extending web members and a plurality of diagonally extending web members also extend between lower rearward frame member 220 and lower forward frame member 222. The ends of the frame members 218, 220 and 222 are provided with flanges F (FIG. 4) to permit adjacent truss sections to be bolted thereto.

Cylinders 200, 202, 204 and 206 are mounted on truss sections 26A, 26B, 26C and 26D respectively. As seen in FIG. 4, the base end of cylinder 202 is pivotally connected to frame member 218 at 230 and extends downwardly therefrom. The lower end of the cylinder rod 232 is connected to a sleeve or tubular member 234 which is vertically movably received by guide collars 236 and 238 secured to frame member 220. A horizontally disposed guide collar 240 is welded or otherwise secured to the lower end of sleeve 234 and has an elongated pipe or tubular member 242 horizontally slidably extending therethrough. The base end of hydraulic cylinder 194 is pivotally connected to collar 240 at 244 and extends horizontally therefrom. The outer end of rod 246 is pivotally secured to clamp 248 which is attached to pipe 242. Thus, vertical movement of rod 232 causes pipe 242 to be vertically moved while horizontal movement of rod 246 causes pipe 242 to be horizontally moved. It should be noted that pipe 242 extends across the length of truss 26, in four sections, and is horizontally slidably received by the collars secured to the vertical cylinders 200, 204 and 206 as well as guide collars at the opposite ends of the truss assembly. It should also be noted that the cylinders 200, 204 and 206 are mounted to the truss sections 26A, 26C and 26D in a similar fashion to that just described.

A plurality of rings or collars 250 are adjustably clamped to the pipe 242 along the length thereof in a predetermined spacing which in the instant example would be two feet. Protective hoses 252 are connected to each of the vibrators 142 and enclose the intake and discharge 144 and 148. The diameter of each of the collars 250 is greater than that of the hose 252 or vibrator 142 to permit the same to loosely extend downwardly therethrough. A clamp 254 embraces each of the hoses 252 above the vibrator 142 for engagement with collar 250 to limit the downward movement of the vibrator 142 with respect to pipe 242. The relationship of the collars 250, the hoses 252 and vibrators 142 is such that the vibrator will enter the concrete, as pipe 242 is lowered, due to its own weight. In other words, there isn't a positive or direct connection between the pipe 242 and the vibrators 142 which forces the vibrators 142 into the concrete as pipe 242 is lowered. This is extremely important where reinforcing rods are positioned within the concrete.

In use, the vibrator machine 10 is positioned on the guide rails 16 and 18 immediately forwardly of the conventional concrete finisher machine. As previously stated, any number of the truss sections may be bolted together to achieve the necessary width of the bridge centering 12. An operator would position himself at the operator's station 90 and activate the power means 70 on drive frame 28 and power means 70' on drive frame 30. The hydraulic circuitry as previously described permits the operator to control the various operations of the machine from the operator's station 90. The concrete generally indicated at 256 is dumped or placed on the bridge centering over the bars 14 in conventional fashion. The fact that the truss 24 extends between the drive frames 28 and 28' near the rearward end thereof permits the workers to level or spread the concrete on the bridge centering closely adjacent the forward end of the truss near the point where the vibrators will vibrate the concrete. When sufficient concrete has been placed on the bridge centering, the operator would actuate control valves 172 and 172' to supply hydraulic fluid to the hydraulic motors 50 and 50' so that the drive frames 28 and 28' will be moved in a forwardly direction generally indicated by arrows in FIG. 1. The manually adjustable valves 177, 179 and 177' and 179' permits the synchronization of the motors 50 and 50' respectively so that the operator may simultaneously fully depress the actuating handles or levers on the valves 172 and 172' whereby both of the drive means 28 and 28' will be moved forwardly at the same rate. Actuation of the motors 50 and 50' causes the drive wheels on the drive frames to be rotated thereby propelling the drive frame along the guide rail.

Control valves 88 and 116 are also operated to cause hydraulic fluid to be supplied to the hydraulic vibrators 142 on each of the truss sections. Control handles 114 and 140 of control valves 88 and 116 are moved with respective to each other until the pressure indicated by gauges 104 and 138 are substantially equal so that the vibrators in gangs VA, VB and VC, VD will be vibrated at the same rate. The manually adjustable valves 145 are also adjusted so that the speed of the vibrators may be matched along the entire length of the truss or may be individually varied as required. When control valve 88 is closed, the hydraulic fluid being supplied thereto through line 76 is returned to the reservoir 86 through the bypass valve 112, line 110, line 106 and line 108. When control valve 88 is partially open, some of the hydraulic fluid is returned to the reservoir 86 by means of lines 106 and 108 while some of the hydraulic fluid will be returned to the reservoir by means of bypass valve 112, lines 110 and 108. When control valve 116 is closed, the hydraulic fluid being supplied thereto by the pump 72' will be returned to the reservoir 86' by means of bypass valve 136, line 134 and line 132. With control valve 116 partially open, some of the hydraulic fluid will be returned to the reservoir 86' by means of the lines 130 and 132 while some of the hydraulic fluid will be returned to the reservoir by means of bypass valve 136, lines 134, 130 and 132.

Assuming that the concrete being positioned on the bridge centering 12 requires vibration on one foot centers across the width of the bridge centering, the vibrators 142 would be initially positioned on the pipe 242 2 feet apart. The hydraulic cylinder 194 would initially be operated so that the cylinder rod 246 is retracted within the body of the cylinder which would cause the vibrators 142 to be positioned in the position illustrated by solid lines in FIG. 4. Control valve 178 is operated so that the cylinder rods thereof are initially in the retracted position so that the vibrators 142 are positioned above the concrete. The valve 178 is then actuated to cause the cylinder rods of the cylinders 200, 202, 204 and 206 to be extended which causes the pipe 242 and the vibrators 142 to be lowered downwardly into the concrete and to vibrate the same. The control valves 208 on each of the cylinders 200, 202, 204 and 206 would have been previously adjusted so that the extension of the cylinder rods of the vertical cylinders would take a predetermined length of time. Likewise, the valves 210 would have been previously adjusted so that the retraction of the cylinder rods of the vertical cylinders would take a predetermined length of time. Thus, through the adjustment of the valves 208 and 210, the length of time that the vibrators are in the concrete will be able to be precisely controlled since many specifications require that the concrete be vibrated for certain lengths of time.

As previously stated, the lowering of the pipe 242 and the vibrators 142 connected therewith permits the vibrators to enter the concrete by means of their own weight due to the loose connection of the vibrators with respect to the collars 250. If the vibrators should strike a re-bar 14 as they are being lowered into the concrete, the loose connection of the vibrator with respect to the collar 250 will permit the vibrator to slide or deflect away from the re-bar.

After the concrete has been vibrated with one downward and upward movement of the vibrators 142, the horizontal cylinder 194 is actuated by means of the valve 180 so that rod 246 of cylinder 194 is extended which causes the vibrators 142 tc be moved from the position illustrated by solid lines in FIG. 4 to the position illustrated by broken lines in FIG. 4. The stroke of the rod 246 is one foot in this case. As soon as the cylinder rod 246 has been completely extended, the valve 178 is again actuated which causes the vibrators 142 to be again lowered into the concrete as just described. It can be appreciated that the utilization of the cylinder 194 permits the concrete to be vibrated on one foot spacings with vibrators which are spaced 2 feet apart. The cylinder 94 and the spacing of the vibrators 142 on the pipe 242 permits any desired vibration spacing to be achieved.

After the concrete has been vibrated on one foot spacings, the valves 172 and 172' are actuated to cause the drive frames 28 and 28' to be moved a predetermined length down the guide rails 16 and 18 depending upon the specifications. If the specification calls for concrete to be vibrated on one foot longitudinal spacings, the drive frames 28 and 28' would be moved one foot down the length of the guide rails 16 and 18 at which time the vibrators 142 would again be lowered into the concrete.

The design of the truss 26 is also unique in that the rearward end of the truss is vertically disposed so that the vibrators 142 may be positioned adjacent thereto with the vertical cylinders being positioned adjacent thereto. The vertical positioning of the vibrators and the hydraulic cylinders at the rearward end of the truss permit the vibrators to be closely positioned adjacent the forward end of the concrete finishing machine. If the vibrators were positioned too far forwardly of the finishing machine, the vibrated concrete would be too stiff by the time the finishing machine reached the same to enable the finishing machine to satisfactorily finish the concrete. The design of the truss permits the truss to span the distance between the guide rails 16 and 18 and does enable the workmen to work closely adjacent the forward end thereof.

The relationship of the drive units and the truss is also important. As described, the engines are located on the forward ends of frames 30, 30' while the truss assembly is connected to the rearward ends of the frames 30, 30' which distributes the weight of the truss assembly and engines with respect to the guide rails. If the engines and truss assembly were located at one end of the frame, sufficient weight may be exerted on the guide rail so as to collapse the same.

Thus it can be seen that the invention accomplishes at least all of its stated objectives.

I claim:

1. In combination, a pair of spaced-apart guide rails positioned on opposite sides of an area upon which concrete is to be poured, a concrete finisher machine movably mounted on said guide rails and extending therebetween for finishing the concrete poured on said area, and a self-propelled concrete vibrator machine movably mounted on said guide rails and being closely positioned adjacent said concrete finisher for vibrating the concrete in close proximity to said finishing machine, said concrete vibrator machine having a plurality of horizontally spaced and substantially vertically disposed vibrator devices extending between said guide rails and means for raising and lowering said substantially vertically disposed vibrator devices with respect to said concrete.

2. The combination of claim 1 wherein said means for vertically raising and lowering said vibrator devices comprises a hydraulic cylinder means.

3. The combination of claim 2 wherein a first control means is operatively connected to said hydraulic cylinder means for raising and lowering said vibrator devices at a predetermined rate whereby the period of vibrating time may be controlled.

4. The combination of claim 1 wherein said vibrator machine includes a frame means having a plurality of horizontally spaced vibrator supports mounted thereon, said vibrator devices being mounted on said vibrator supports with freedom of relative upward substantially linear movement whereby said vibrator supports permit upward vertical movement of said vibrator devices, relative to said vibrator supports, as said vibrator devices are lowered into the concrete.

5. The combination of claim 1 wherein said vibrator machine includes means for horizontally moving said vibrator devices with respect to said concrete.

6. The combination of claim 5 wherein said means for horizontally moving said vibrator devices comprises a hydraulic cylinder means.

7. The combination of claim 1 wherein said vibrator machine comprises a first frame means movably mounted on one of said guide rails, a second frame means movably mounted on the other of said guide rails, and a truss assembly extending between said first and second frame means above the surface upon which the concrete is to be poured, said vibrator devices being mounted on and supported by said truss assembly, and first and second drive units on said first and second frame means respectively for selective movement of said frame means with respect to said guide rails, said truss assembly comprising a substantially horizontally disposed truss portion having rearward and forward ends, a substantially vertically disposed truss portion secured to and extending upwardly from the rearward end of said horizontally disposed truss portion; and an inclined truss portion secured to and extending between the upper end of said vertically disposed truss portion and the forward end of said horizontally disposed truss portion, said vibrator devices being positioned adjacent the rearward side of said vertically disposed truss portion, said first and second frame means each having rearward and forward ends with respect to the direction of travel thereof, said truss assembly extending therebetween at the rearward ends thereof.

8. The combination of claim 7 wherein said truss assembly comprises a plurality of truss sections which are detachably secured together in an end-to-end relationship to permit said truss assembly to span various guide rail spacings.

9. The combination of claim 7 wherein said truss assembly is laterally adjustably mounted on said first and second frame means to permit said truss assembly to span various guide rail spacings.

10. The combination of claim 7 wherein an operator's station is provided on said truss assembly.

11. The combination of claim 7 wherein said first and second drive units are supported on the forward ends of said first and second frame means respectively, each frame means including longitudinally spaced apart wheel assemblies movable on said guide rails for distributing the weight of said vibrator machine therealong.

12. The combination of claim 1 whereby means is provided for varying the vibrational speed of said vibrator devices.

13. The combination of claim 1 wherein a control means is operatively connected to said hydraulic cylinder means for controlling the time that said vibrator devices are positioned within the concrete.

14. A self-propelled concrete vibrator machine for movement along a pair of spaced-apart guide rails positioned on opposite sides of an area upon which conrete is to be poured, first and second drive frames for mounting on said guide rails and a truss assembly secured to said drive frames and extending therebetween above said area, a plurality of horizontally spaced vibrator devices mounted on said truss assembly, said vibrator devices secured in substantially vertically disposed relation to said truss assembly, and means for raising and lowering said substantially vertically disposed vibrator devices with respect to the concrete.

15. The device of claim 14 wherein said means for vertically raising and lowering said vibrator devices comprises a hydraulic cylinder means.

16. The device of claim 15 wherein a first control means is operatively connected to said hydraulic cylinder means for raising and lowering said vibrator devices at a predetermined rate whereby the period of vibrating time may be controlled.

17. The device of claim 14 wherein said truss assembly includes a frame means having a plurality of horizontally spaced vibrator supports mounted thereon, said vibrator devices being mounted on said vibrator supports whereby said vibrator supports permit upward vertical movement of said vibrator devices, relative to said vibrator supports, as said vibrator devices are lowered into the concrete.

18. The device of claim 14 wherein said vibrator machine includes means for horizontally moving said vibrator devices with respect to said concrete.

19. The device of claim 18 wherein said means for horizontally moving said vibrator devices comprises a hydraulic cylinder means.

20. The device of claim 14 wherein said first and second drive frames include means for selective movement of said frames with respect to said guide rails.

21. The device of claim 14 wherein said truss assembly comprises a substantially horizontally disposed truss portion having rearward and forward ends, a substantially vertically disposed truss portion secured to and extending upwardly from the rearward end of said horizontally disposed truss portion; and an inclined truss portion secured to and extending between the upper end of said vertically disposed truss portion and the forward end of said horizontally disposed truss portion, said vibrator devices being positioned adjacent the rearward side of said vertically disposed truss portion.

22. The device of claim 21 wherein said first and second drive frames each have rearward and forward ends with respect to the direction of travel thereof, said truss assembly extending therebetween at the rearward ends thereof.

23. The device of claim 14 wherein said truss assembly comprises a plurality of truss sections which are detachably secured together in an end-to-end relationship to permit said truss assembly to span various guide rail spacings.

24. The device of claim 14 wherein said truss assembly is laterally adjustably mounted on said first and second drive frames to permit said truss assembly to span various guide rail spacings.

25. The device of claim 14 wherein an operator's station is provided on said truss assembly.

26. The device of claim 14 whereby means is provided for varying the vibrational speed of said vibrator devices.

27. The device of claim 14 wherein a control means is provided for selectively moving either of said drive frames relative to said guide rails in forward and rearward directions.

28. The device of claim 14 wherein said means for vertically raising and lowering said vibrator devices comprising a hydraulic cylinder means and a control means is operatively connected to said hydraulic cylinder means for controlling the time that said vibrator devices are positioned within the concrete.

29. In combination, a bridge, bridge centering on said bridge including a pair of spaced-apart and longitudinally extending guide rails positioned on opposite sides of the area upon which conrete is to be poured, a concrete finisher machine movably mounted on said guide rails and extending therebetween for finishing the concrete poured on said area, and a self-propelled concrete vibrator machine movably mounted on said guide rails and being closely positioned adjacent said concrete finisher for vibrating the concrete in close proximity to said finishing machine, said concrete vibrator machine having a plurality of horizontally spaced and substantially vertically disposed vibrator devices extending between said guide rails, and means for vertically raising and lowering said vibrator devices with respect to said concrete.

30. The combination of claim 29 wherein said means for vertically raising and lowering said vibrator devices comprises a hydraulic cylinder means.

31. The combination of claim 30 wherein a first control means is operatively connected to said hydraulic cylinder means for raising and lowering said vibrator devices at a predetermined rate whereby the period of vibrating time may be controlled.

32. The method of creating a bridge deck upon a bridge, comprising the steps of:

(a) positioning a pair of spaced-apart guide rails on opposite sides of the area upon which concrete is to be poured;

(b) pouring concrete on said area across the width thereof;

(c) positioning a self-propelled concrete vibrator machine on said guide rails whereby said vibrator machine extends between said guide rails;

(d) lowering a plurality of vertically disposed and horizontally spaced vibrator devices from said vibrator machine into said concrete;

(e) raising said vibrator devices from said concrete;

(f) moving said vibrator machine longitudinally along said guide rails; and (g) finishing said concrete with a concrete finishing machine which is movably positoned on said guide rails closely adjacent said vibrator devices.

33. The method of claim 32 wherein said vibrator devices are moved laterally after being raised in step (e) and are then lowered into the concrete and raised therefrom prior to step (f).

34. The method of claim 32 wherein said vibrator devices vibrate said concrete at a predetermined vibrational rate for a predetermined length of time.

* * * * *